United States Patent [19]

Adler et al.

[11] Patent Number: 4,767,962

[45] Date of Patent: Aug. 30, 1988

[54] COLOR CATHODE RAY TUBE AND TENSIBLE SHADOW MASK BLANK FOR USE THEREIN

[75] Inventors: Robert Adler, Northfield; Charles J. Prazak, III, Elmhurst, both of Ill.

[73] Assignee: Zenith Electronics Corporation, Glenview, Ill.

[21] Appl. No.: 881,169

[22] Filed: Jul. 2, 1986

[51] Int. Cl.[4] ..... H01J 9/18

[52] U.S. Cl. ..... 313/402; 445/47

[58] Field of Search ..... 445/47; 313/407, 402, 313/403

[56] References Cited

U.S. PATENT DOCUMENTS

| | | | |
|---|---|---|---|
| 2,625,734 | 1/1953 | Law | 29/25.13 |
| 3,390,447 | 7/1968 | Mears | 20/472.3 |
| 3,809,945 | 5/1974 | Roeder | 313/85 |
| 3,862,448 | 1/1975 | Ishizuka | 313/402 |
| 3,894,321 | 7/1975 | Moore | 29/25.25 |
| 4,437,036 | 3/1984 | Ragland, Jr. | 313/402 |
| 4,599,533 | 7/1986 | Ragland, Jr. | 313/407 |
| 4,652,791 | 3/1987 | Palac et al. | 313/402 |

FOREIGN PATENT DOCUMENTS

| | | | |
|---|---|---|---|
| 1200833 | 2/1986 | Canada | 313/403 |
| 2407295 | 8/1974 | Fed. Rep. of Germany | 313/402 |
| 0057776 | 5/1977 | Japan | 313/402 |
| 0063662 | 5/1977 | Japan | 313/402 |
| 1333728 | 10/1980 | Japan | 445/47 |
| 0165249 | 12/1981 | Japan | 313/402 |
| 0202626 | 12/1982 | Japan | 313/402 |
| 1163495 | 6/1967 | United Kingdom . | |

*Primary Examiner*—Kurt Rowan

[57] ABSTRACT

A shadow mask blank is disclosed for use in the manufacture of an ultra-high resolution color cathode tube. The mask blank is adapted to be expanded and secured under tension in spaced adjacency to the screen of the tube. The blank comprises a central field of electron-beam-passing apertures, an outer band adapted to be gripped during the expanding, and at least one field of selectively weakened metal between the central field and the outer band. The selectively weakened metal is effective to equalize stress and prevent wrinkling of the blank under electron beam heating when the blank is expanded and secured under tension. An inner band peripheral to the central field may be provided for mounting the blank on a support structure and securing it thereto. Means may also be provided for linking the inner band with the outer band to selectively strengthen weakened areas.

5 Claims, 3 Drawing Sheets

COLOR CATHODE RAY TUBE AND TENSIBLE SHADOW MASK BLANK FOR USE THEREIN

CROSS-REFERENCE TO RELATED APPLICATIONS AND PATENTS

This application is related to but in no way dependent upon copending applications Ser. No. 729,020, now U.S. Pat. No. 4,652,791 filed Apr. 30, 1985; Ser. No. 808,137 filed Dec. 11, 1985; Ser. No. 832,568 filed Feb. 21, 1986; Ser. No. 832,493 filed Feb. 21, 1986; Ser. No. 832,556 filed Feb. 21, 1986; Ser. No. 835,845 filed Mar. 3, 1986; Ser. No. 866,030 filed May 21, 1986; Ser. No. 843,890 filed Mar. 25, 1986; Ser. No. 875,123 filed June 17, 1986; and U.S. Pat. Nos. 4,547,696; 4,591,344; 4,593,224; 4,593,225; and 4,595,857, all of common ownership herewith.

This specification includes an account of the background of the invention, a description of the the best mode presently contemplated for carrying out the invention, and appended claims.

BACKGROUND OF THE INVENTION

Field of the Invention

This invention relates to color cathode ray picture tubes, and is addressed specifically to an improved shadow mask blank for use in the manufacture of color tubes having shadow masks of the tension foil type mounted in association with a substantially flat faceplate. The invention is applicable in color tubes of various types, including those used in home entertainment television receivers, and in medium-resolution, high-resolution, and ultra-high resolution tubes intended for color monitors.

The use of the tension foil mask and flat faceplate provides many benefits when compared to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high-brightness where the intensity of the electron beam bombardment is greatest. Color impurities result as the mask moves closer to the faceplate and as the beam-passing apertures move out of registration with the phosphor deposits. The tension foil mask will not dome, but the heating effect of the electron beams on the mask can exert another undesired effect on the thin metal foil in that the foil can wrinkle, especially in corner areas. Such wrinkling can have a deleterious effect on picture tube resolution and color purity.

The tension foil shadow mask is a part of the cathode ray tube front assembly, and is located in spaced adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode or parallax barrier which ensures that each of the three beams projected by the electron gun lands only on its assigned phosphor deposits on the screen.

Prior Art

The following examples are being submitted to the Patent and Trademark Office for evaluation as to possible relevance to the claimed subject matter. The examples are believed to be the closest of the art of which applicants are aware, but applicants make no admission as to its relevance in fact, to its legal sufficiency, or to its priority in time, nor do applicants represent that no better art exists.

There have been a number of disclosures of tensed foil masks and means for applying and maintaining mask tension. Typical of these is the disclosure of Law in U.S. Pat. No. 2,625,734, which addresses the construction of a taut, planar, foraminous mask, and the mounting of the mask and target (the screen on the faceplate) as a unitary assembly within the enevelope. The thin metal is clamped in a frame, and the mask is heated and placed under screw tension. Upon cooling, the metal contracts and the mask is thus rendered taut and held in tension by the frame.

In U.S. Pat. No. 1,163,495 (GB), a multitude of narrow tabs preferably a fraction of a millimeter wide are shown as extending from a thin metal sheet intended as a shadow mask. The object is to provide means whereby such a thin sheet can be fixed in place without the need for a heavy frame. The sheet is placed under tension, and the tabs are said to maintain a constant, uniform tension. The mask is attached directly to the glass of the envelope by the tabs, the ends of which are sealed into the glass.

In U.S. Pat. No. 3,894,321 to Moore, of common ownership herewith, there is disclosed a foil mask having a central area of apertures for color selection, and an outer sealing area perforated with a plurality of openings through which frit sealing material can flow. The unperforated area between the central area and the outer sealing area is said to act as an electron shield.

Mears in U.S. Pat. No. 3,390,447 discloses a rectangular, centrally apertured sheet which has a series of mounting holes along the edges. Additional holes are provided for mounting a mask to the particular instrument with which it is to be used. The holes can be used for alignment to form a relatively thick apertured stack from layers of thin sheets.

In U.S. Pat. No. 3,809,945 to Roeder, of common ownership herewith, there is disclosed means for ameliorating the effects of the non-uniform stretching and deformation of apertured mask blanks during the mask-forming operation used in the manufacture of curved, non-tensed shadow masks having a thickness of about 0.006 inch, and intended for use in conventional curved-faceplate cathode ray tubes. The undesired effects include non-uniform enlargement of the mask holes and distortion in hole shape at the periphery of the aperture pattern. A preferred embodiment of the invention provides for a transition structure in the stressed areas having a plurality of rows of apertures etched only part-way through. Transition structures are also described in which material is removed from an area, or the area is thinned.

OBJECTS OF THE INVENTION

It is an object of the invention to provide an improved shadow mask component for installation during manufacture of color cathode ray tubes having the tensed foil shadow mask.

It is another object of the invention to provide a color cathode ray tube with an improved shadow mask of the tensed foil type, and with a configuration that ensures wrinkle-free planarity of the mask during tube operation.

It is yet another object of the invention to provide a shadow mask blank that provides stress-equalizing means to prevent wrinkling of the mask under electron beam bombardment after the mask has been expanded and secured under tension.

DESCRIPTION OF THE PREFERRED EMBODIMENT

Figure 1:
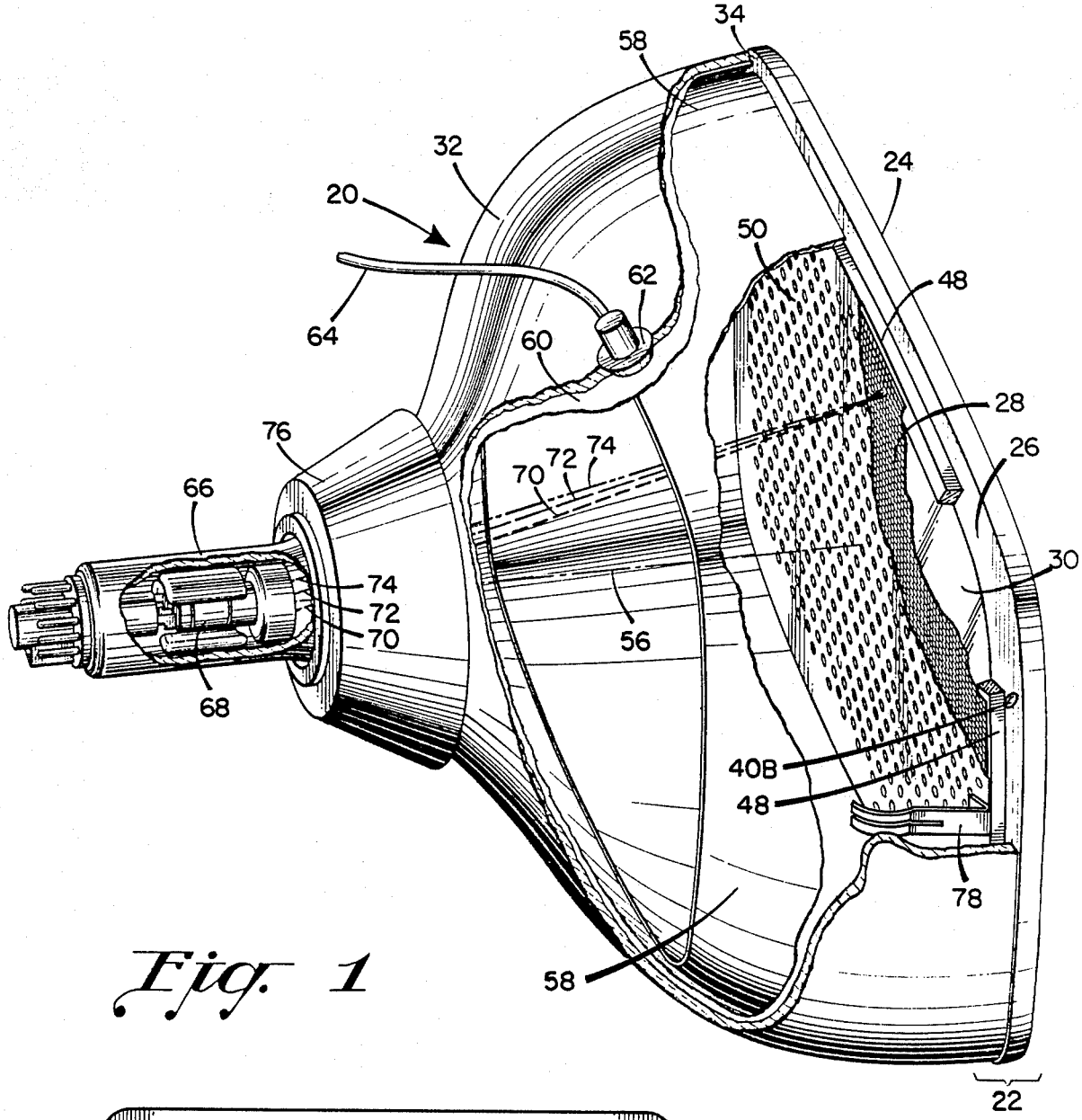
FIG. 1 is a side view in perspective of a color cathode ray tube having a tensed foil shadow mask formed from a shadow mask blank according to the invention, with cut-away sections that indicate the location and relation of the mask to other major tube components.

The operating environment of a tension foil shadow mask formed from a preferred embodiment of a shadow mask blank according to the present invention is the cathode ray tube depicted in FIG. 1. The tube and its component parts are identified and described in the following paragraphs in this sequence: reference number, a reference name, and a brief description of structure, interconnections, relationship, functions, operation, and/or result, as appropriate.

Figure 2:
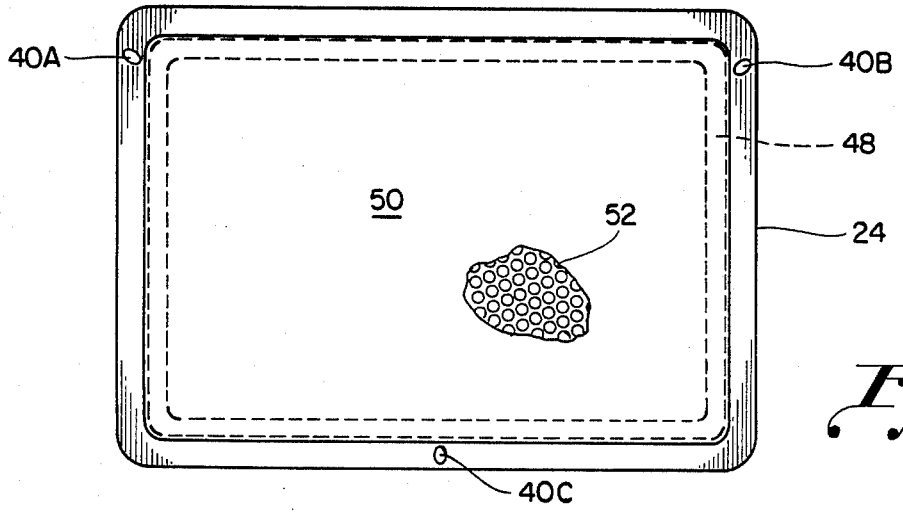
FIG. 2 is a plan view of the front assembly of the tube shown by FIG. 1 as seen from the gun end of the tube, and depicting the relationship of the shadow mask and faceplate of FIG. 1; an inset depicts mask apertures greatly enlarged.

(With initial reference to FIGS. 1 and 2.)

20 color cathode ray tube
22 front assembly
24 faceplate
26 inner surface of faceplate
28 centrally disposed phosphor screen
30 film of aluminum
32 funnel
34 peripheral sealing area of faceplate, adapted to mate with the funnel
40A, 40B, 40C V-grooves, which are one component of ball-and-groove indexing means for registering the faceplate with the funnel
48 shadow mask support structure, for mounting a shadow mask
50 a metal foil shadow mask; after being expanded, the mask is mounted on support structure 48 and secured thereto; from the viewpoint of FIG. 2, shadow mask support structure 48 is shown by the dashed lines as underlying mask 50
52 shadow mask apertures, indicated greatly enlarged in the inset
56 anterior-posterior axis of tube
58 internal magnetic shield—"IMS"
60 internal conductive coating on funnel
62 anode button
64 high-voltage conductor
66 neck of tube
68 in-line electron gun providing three discrete in-line electron beams for exciting the triads of phosphors deposited on screen 28. The gun may be one of the types disclosed in referent copending applications Ser. No. 808,137 and Ser. No. 828,568
70, 72, 74 electron beams for activating respective red-light-emitting, green-light emitting, and blue-light-emitting phosphor deposits on screen 28
76 yoke which provides for the traverse of beams 70, 72 and 74 across screen 28
78 contact spring which provides an electrical path between the funnel coating 60 and the mask support structure 48

DESCRIPTION OF THE INVENTION

A major step in the process of manufacturing a cathode ray tube having a tensed foil shadow mask is that of installing the shadow mask blank. The mask blank must be expanded into a tensed state, then retained in that state. This can be done two ways: (1) The mask can be expanded by stretching it mechanically, and then clamping it to retain it in a stretched condition; or (2), the mask blank can be heated in a frame equipped with clamps—the mask is heated, but the frame remains cool. When the mask is fully expanded, the clamps are applied, and the mask is allowed to cool. As the blank cools, it attempts to shrink, but cannot do so because it is clamped to the frame, hence it is held in tension.

Figure 3:
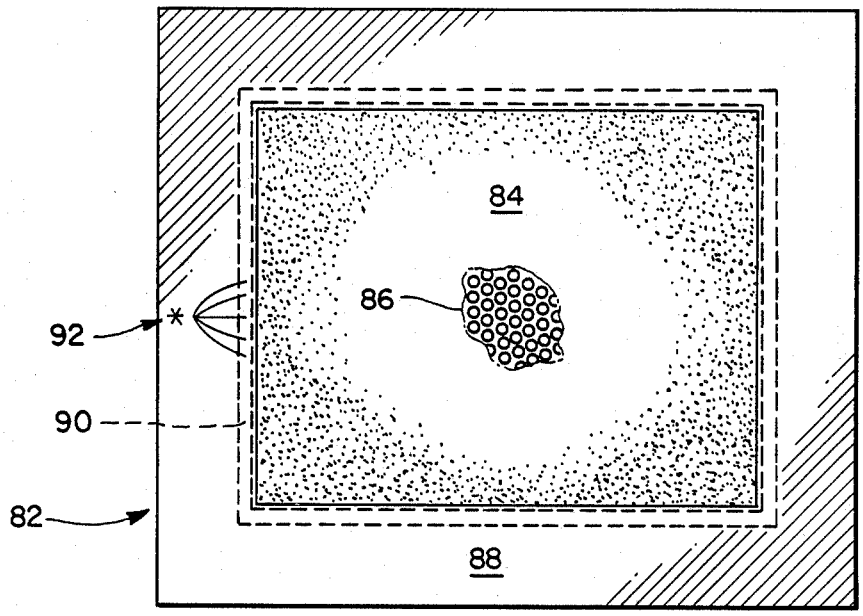
FIG. 3 is a plan view of an early embodiment of a shadow mask blank which displays the problem of wrinkling resolved by the present invention.

An early embodiment of a shadow mask blank is depicted in FIG. 3. Blank 82 is comprised of a central field 84 of elecron-beam-passing apertures indicated by the inset of 86 as being circular. The apertures for an ultra-high resolution cathode ray tube may have a diameter of the order of 0.003 inch, by way of example. The central field 84 is indicated as being enclosed by a peripheral outer band 88 of solid metal. Outer band 88 serves two purposes: (1) it provides a surface for gripping the blank during the expanding of the blank in tensioning; and (2) it provides an area for welding the mask to an underlying support structure 90, indicated by the dashed lines. As has been noted, mask support structure 90 serves for mounting and securing the shadow mask after it has been expanded. Securing of the mask blank 82 to the support structure 90 (while the blank is expanded) is indicated schematically by the weldment symbol 92, with lines radiating to the weld points. In a 14-inch tube, as many as 1,000 such welds, preferably at intervals of about 0.040 inch, are required to ensure positive securement of the mask to the underlying support structure. After welding, the excess material of outer band 88 is trimmed off along the outer edge of the dashed line that indicates the underlying support structure 90.

Figure 4:
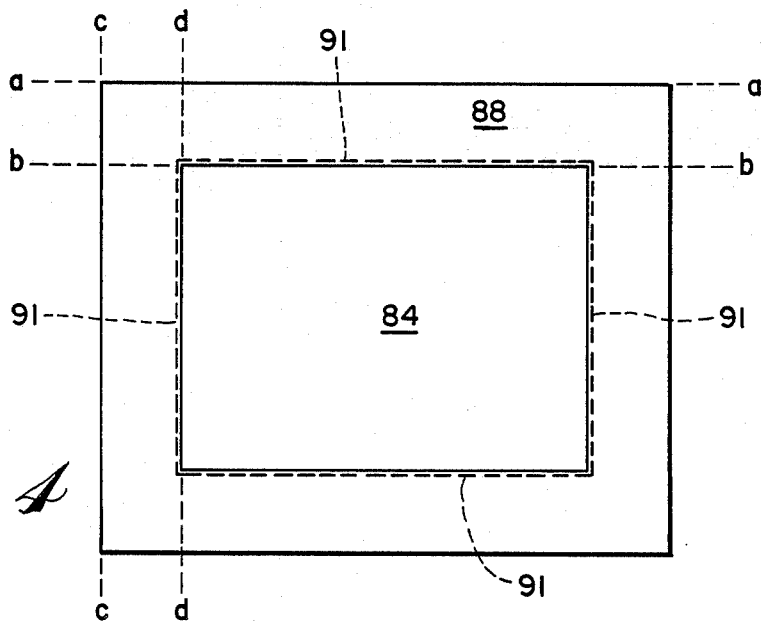
FIG. 4 is another plan view of the shadow mask blank shown by FIG. 3 which depicts the effect on the central field of apertures that results when the blank is stretched.

A problem of shadow mask wrinkling arose during tube operation, the solution of which is addressed by the present invention. With reference now to FIG. 4, there is shown a representation of the mask blank 82 of FIG.

3 depicting the effect on the central field 84 which results when the mask blank is stretched, be it by mechanical or thermal means. As indicated by the dashed lines 91 on the periphery of central field 84 of electron-beam-passing apertures, the central field 84 bows outwardly in barrel distortion. Such distortion results in a highly non-uniform distribution of stress, with large shearing stresses appearing near the front corners of central field 84. If the mask were uniform throughout its area, it would also remain uniform when under tension. This however is not the case, as shown by FIG. 4.

The mask blank 82 consists essentially of a solid portion 88 shaped like a frame, with an apertured portion 84 inside the frame. This is the configuration depicted in FIG. 4: the solid lines marked a, b, c, and d indicate the outlines of the solid portion; the rectangle inside—the central field 84—is the apertured portion.

Figure 5:
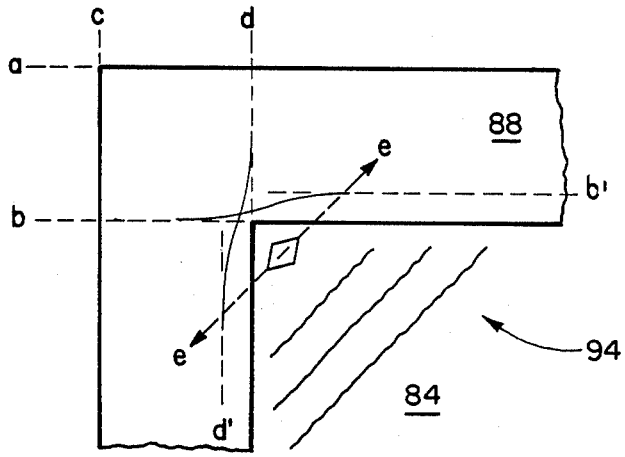
FIG. 5 is a plan view of a corner of the mask blank depicted in FIG. 4 wherein the origin of the non-uniform stretching and wrinkling problem is analyzed graphically.

In testing, a mask cracked along the boundary between the solid portion and the apertured portions in consequence of the non-uniform distribution of stresses. FIG. 5 which for clarity depicts only the upper left corner of the mask of FIG. 4, shows in more detail what happens when a mask of the configuration described is put under tension.

Assume first that the mask cut were along d, and put under purely vertical tension. The rectangular strip to the left of the cut, i.e., between lines c and d, is completely solid from top to bottom. When it is stressed vertically, the stress distribution remains uniform throughout. Assume now that the dotted part of line b had actually been painted on the strip, then if the strip were put under vertical tension, the spacing between lines a and b would increase from the non-stressed condition by an amount proportional to the increase in the overall length of the strip. FIG. 5 shows lines a and b in this stressed condition.

Turning now to the portion of the mask to the right of line d, this consists of the solid portion between lines a and b, the perforated portion beginning at b and continuing below, and a symmetrically placed solid portion on the bottom (not shown). With respect to purely vertical stress, these three portions of material are mechanically connected in series. The average stiffness of the perforated portion is considerably less than that of the solid portions. Since the force applied to the three portions in series must be the same, the perforated portion will expand more than its proportional share, and the two solid portions will expand less. This condition is indicated by line b′, which depicts the position of the boundary between the upper solid portion and the perforated portion under the assumption that the overall vertical length of the three portions remains the same as the vertical length of the all-solid strip to the left of line d. Thus, if the mask were cut along line d, the locations of line b to the left and b′ to the right would not match after the mask had been stretched vertically. There would be a break at line d, with the right part b′ being closer to the periphery a than the left part b. In reality, of course, the mask is not being cut, so no such break can exist, and there will be a gradual transition from b to b′ as indicated in FIG. 5.

The same logic can be used to show that when the mask is stretched horizontally as well as vertically, lines d and d′ will not match, and again there will be a gradual transition as shown by FIG. 5. The overall effect is a distortion at the corner; the angle between the actual boundaries of the perforated portion is no longer 90 degrees, but larger. Near the corner, in the perforated region, there exists a condition of shearing stress. The tension along directions e—e is much higher than the tension at right angles to that direction. As a consequence, when such a mask is placed into a tube and then uniformly heated by the electron beams, it tends to form wrinkles in the corners parallel to the direction e—e, as indicated by the series of wrinkles 94 shown in FIG. 5. The result is loss of color purity in the affected areas since movement of the mask of as little as a few ten-thousandths of an inch can overcome the guardband in ultra-high resolution color tubes.

Figure 6:
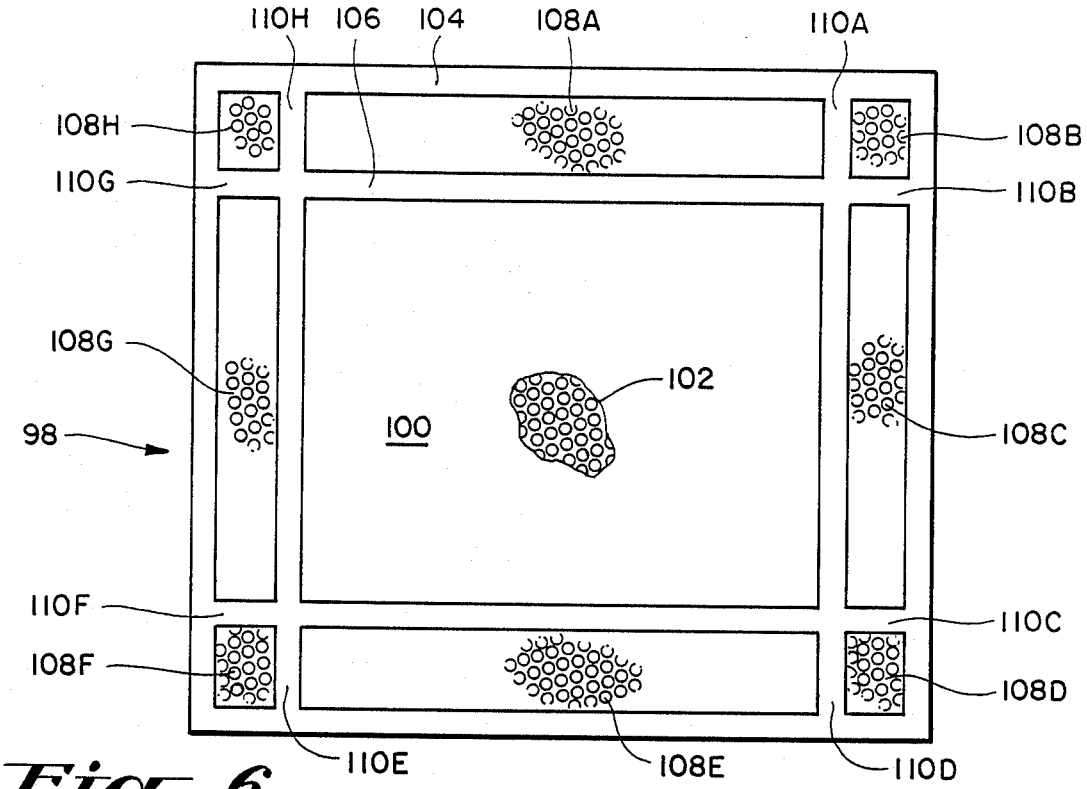
FIG. 6 is a plan view of the preferred embodiment of the shadow mask blank according to the invention; and, FIG. 7 is a plan view of another embodiment of the shadow mask blank according to the invention.

A preferred embodiment of the inventive solution to the wrinkling problem is depicted in FIG. 6. A shadow mask blank 98 according to the invention is shown as having a central field 100 of electron-beam-passing apertures for color selection consonant in dimensions with the screen of the tube. Shadow mask blank 98 according to the invention is shown as having a peripheral outer band 104 adapted to be gripped during the expanding of the mask blank 98. The embodiment of FIG. 6 is shown as also having an inner band 106 peripheral to the central field 100 for mounting the blank on a support structure and securing it thereto, as has been described. Inner band 106 is preferably solid (unperforated) metal as indicated, for image edge definition as well as for purposes of welding the blank 98 to the mask support structure. Embodiments of mask support structures suitable for mounting and securing a shadow mask blank according to the invention are fully described and claimed in the referent copending applications Ser. Nos. 832,493; 832,556; 835,845, and 868,030.

The shadow mask blank according to the invention has at least one field of selectively weakened metal between the outer and inner bands. Blank 98 is depicted as having eight such fields between the central field 100 and the outer band 104. This selectively weakened metal is effective to equalize stress and prevent wrinkling of the blank under electron beam heating when the blank is expanded and secured under tension. Areas of selectively weakened metal are indicated by the FIG. 6 embodiment as comprising fields of stress-equalizing perforations 108A–108H; the perforations are represented schematically by a cluster of circles, with the perforations noted as completely filling the areas between the bands.

Means are provided according to the invention for linking the inner band 106 with the outer band 104. The means are shown as being linear extensions of inner band 106 comprising discrete bands 110A–110H of unweakened metal and shown as consisting of two such linearily extending bands in each corner of the mask blank 98.

The means for linking the inner band 106 with the outer band 104 is effective according to the invention to selectively strengthen weakened areas of the mask blank 98, while the fields of perforations are effective to equalize stress to prevent wrinkling of blank 98 under electron beam heating when the blank is expanded and secured to the mask support structure.

Figure 7:
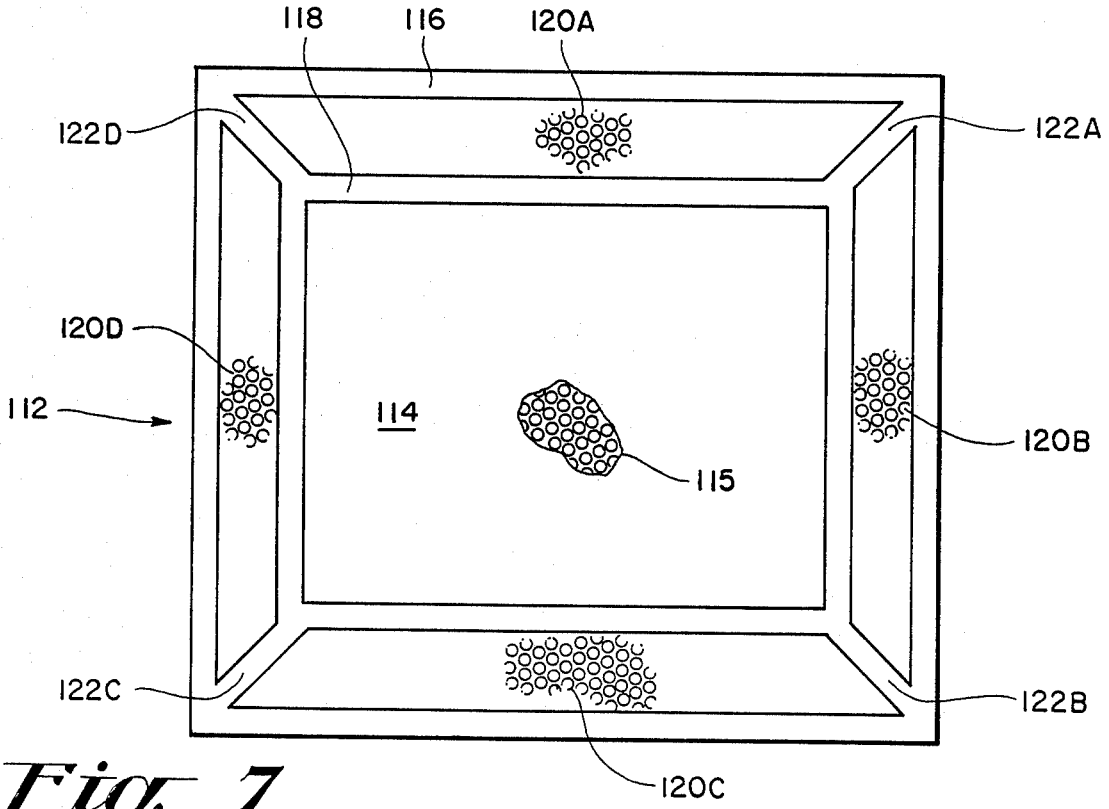

Another embodiment of the shadow mask blank according to the invention is depicted in FIG. 7. The blank 112 is indicated as having a central field 114 of electron-beam-passing apertures, as shown by the enlarged inset 115. Blank 112 also has an outer band 116 which is peripheral to the blank, an inner band 118 peripheral to the central field 114, and fields of stress-equalizing perforations 120A–120D between the outer band 116 and the inner band 118; as has been noted, the perforations, represented schematically by a cluster of circles, fill the areas between the bands. According to this embodiment of the invention, means for linking inner band 118 with outer band 116 comprises discrete, radially extending bands 122A–D of unweakened metal, shown as being unperforated. One such radially extending band is perferably located in each corner of the mask blank, as indicated.

The width and height dimensions of a mask blank for a tube having a display field of 10.75 inches by 8 inches is preferably about 15.5 inches by 13.5 inches. (All dimensions are approximations, and are provided by way of example.) With reference to the embodiment of the shadow mask blank 98 shown by FIG. 6 for example, the approximate width dimensions of the inner and outer bands may be as follows: outer band 104, 0.5 inch; top and bottom sections of inner band 106, 0.55 inch; side sections of inner band 106, 0.6 inch. The width of the top and bottom areas having stress-equalizing perforations is 1.6 inches, and of the side areas, 1.25 inches. The stress-equalizing perforations preferably have a constant pitch of 0.008 inch and may have a constant diameter of about 0.003 inch, which is noted as being of the same diameter as the electron-beam passing apertures. The openess of the areas with stress-equalizing perforations is preferably about 20 percent. The hole patterns for both the beam-passing apertures and the stress-equalizing perforations are preferably oriented the same along the "X" or horizontal direction.

The mask blank may be formed by electroforming, in which case it may have a maximum thickness of about 0.0005 inch. If formed from a metal foil, maximum thickness is preferably about 0.0010 inch. The thermal expansion coefficient of the material is desirably from 12.0 to $15.1\times10^{-6}$ per degree C. The yield strength at 20 degrees C. is 75.0 kpsi minimum after four hours at 435 degrees C. The electron-beam passing apertures and stress-equalizing perforations are preferably formed by the photo-etching process.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. For use in the manufacture of a tension mask color cathode ray tube, a rectangular, selectively weakened metal shadow mask blank adapted to be expanded and secured under tension to a mask support structure in spaced adjacency to the screen of said tube, said blank comprising:

a central field of electron-beam-passing apertures for color selection consonant in dimensions with said screen;

a peripheral outer band adapted to be gripped during the expanding and mounting of said mask blank on said mask support structure;

an inner band peripheral to said central field for mounting said blank on said support structure and securing it thereto;

at least one field of stress-equalizing perforations between said outer band and said inner band;

said blank having strengthening areas in corner regions thereof between said inner and outer bands having a width dimension many times the pitch of said stress-equalizing perforations;

whereby said strengthening areas being effective to selectively strengthen weakened areas, and said field of perforations is effective to equalize stress to prevent wrinkling of said blank under electron beam heating when said blank is expanded and secured to said mask support structure.

2. The shadow mask blank of claim 1 wherein said inner band and said outer band are linked by linear extensions of said inner band comprising discrete bands of unweakened metal.

3. For use in the manufacture of a tension mask color cathode ray tube, a selectively weakened metal shadow mask blank adapted to be expanded and secured under tension to a mask support structure in spaced adjacency to the screen of said tube, said blank comprising:

a central field of electron-beam-passing apertures for color selection consonant in dimensions with said screen;

a peripheral outer band adapted to be gripped during the expanding and mounting of said mask blank on said mask support structure;

an inner band peripheral to said central field for mounting said blank on said support structure and securing it thereto;

at least one field of stress-equalizing perforations between said outer band and said inner band;

means for linking said inner band with said outer band comprising a discrete, radially extending band of unweakened metal in each corner;

whereby said means for linking said inner band with said outer band is effective to selectively strengthen weakened areas, and said field of perforations is effective to equalize stress to prevent wrinkling of said blank under electron beam heating when said blank is expanded and secured to said mask support structure.

4. for use in the manufacture of a tension mask color cathode ray tube, a selectively weakened metal shadow mask blank adapted to be expanded and secured under tension to a mask support structure in spaced adjacency to the screen of said tube, said blank comprising:

a central field of electron-beam-passing apertures for color selection consonant in dimensions with said screen;

a peripheral outer band adapted to be gripped during the expanding and mounting of said mask blank on said mask support structure;

an inner band peripheral to said central field for mounting said blank on said support structure and securing it thereto;

at least one field of stress-equalizing perforations between said outer band and said inner band;

means for linking said inner band with said outer band by linear extensions of said inner band comprising discrete imperforate bands of unweakened metal each having a width dimension many times the pitch of said stress-equalizing perforations;

whereby said means for linking said inner band with said outer band is effective to selectively strengthen weakened areas, and said field of perforations is effective to equalize stress to prevent wrinkling of said blank under electron beam heating when said blank is expanded and secured to said mask support structure.

5. For use in the manufacture of a tension mask color cathode ray tube, a rectangular, selectively weakened metal shadow mask blank adapted to be expanded and secured under tension to a mask support structure in spaced adjacency to the screen of said tube, said blank comprising:

a central field of electron-beam-passing apertures for color selection consonant in dimensions with said screen;

a peripheral outer band adapted to be gripped during the expanding and mounting of said mask blank on said mask support structure;

an inner band peripheral to said central field for mounting said blank on said support structure and securing it thereto;

at least one field of stress-equalizing perforations between said outer band said inner band;

discrete, radially extending bands of unweakened metal linking said inner band and said outer band in each corner of said blank, said radially extending bands having a width dimension many times the pitch of of said stress-equalizing perforations;

whereby said radially extending bands are effective to selectively strengthen weakened areas, and said field of perforations is effective to equalize stress to prevent wrinkling of said blank under electron beam heating when said blank is expanded and secured to said mask support structure.

* * * * *